US005115661A

United States Patent [19]

McGowan

[11] Patent Number: 5,115,661

[45] Date of Patent: May 26, 1992

[54] FORMING PARTS FROM DUCTILE MATERIALS

[76] Inventor: Joseph McGowan, 57 Winckley Road, Broadgate, Preston, Lancashire, England

[21] Appl. No.: 510,250

[22] Filed: Apr. 18, 1990

[51] Int. Cl.[5] ..... B21D 25/02

[52] U.S. Cl. ..... 72/297; 72/22

[58] Field of Search ..... 72/22, 294, 297, 335

[56] References Cited

U.S. PATENT DOCUMENTS

| | | | |
|---|---|---|---|
| 2,309,942 | 2/1943 | Ekstedt et al. | 72/335 |
| 2,872,964 | 2/1959 | Hollis | 72/297 |
| 2,924,261 | 2/1960 | Zygmunt . | |
| 2,961,028 | 11/1960 | Bath | 72/297 |
| 2,986,194 | 5/1961 | De Marco | 72/297 |
| 3,354,688 | 11/1967 | Bodine, Jr. . | |
| 3,392,566 | 7/1968 | Sporck | 72/377 |
| 3,596,492 | 3/1971 | Swanson | 72/297 |
| 4,077,247 | 3/1978 | Stewart | 72/335 |
| 4,857,412 | 8/1989 | Fleury | 72/377 |

FOREIGN PATENT DOCUMENTS 2147533A 5/1985 United Kingdom .

OTHER PUBLICATIONS

Patent Abstracts of Japan, vol. 7, No. 237 (M-250) (1382) Oct. 11, 1983.

*Primary Examiner*—Lowell A. Larson

*Attorney, Agent, or Firm*—Nixon & Vanderhye

[57] ABSTRACT

Method of stretch forming a workpiece comprising placing the workpiece on a former, gripping the workpiece by at least one gripper, pulling the workpiece to a desired configuration over the former by the at least one gripper, disposing a force-applying device between a fixed reaction workpiece and the workpiece and applying a desired force to the surface of the workpiece, such that the force is reacted by the force-applying device and the reaction surface. The position of the force-applying device is altered by a positioning device such that as the force is applied to different parts of the surface of the workpiece the force continues to be reacted through the force-applying device and the reaction surface in preference to being reacted through the positioning device. The positioning device is also operable to alter the position of the force applying device independently of the position of the grippers. Apparatus is also provided for carrying out the method.

8 Claims, 2 Drawing Sheets

FORMING PARTS FROM DUCTILE MATERIALS

Figure 1:
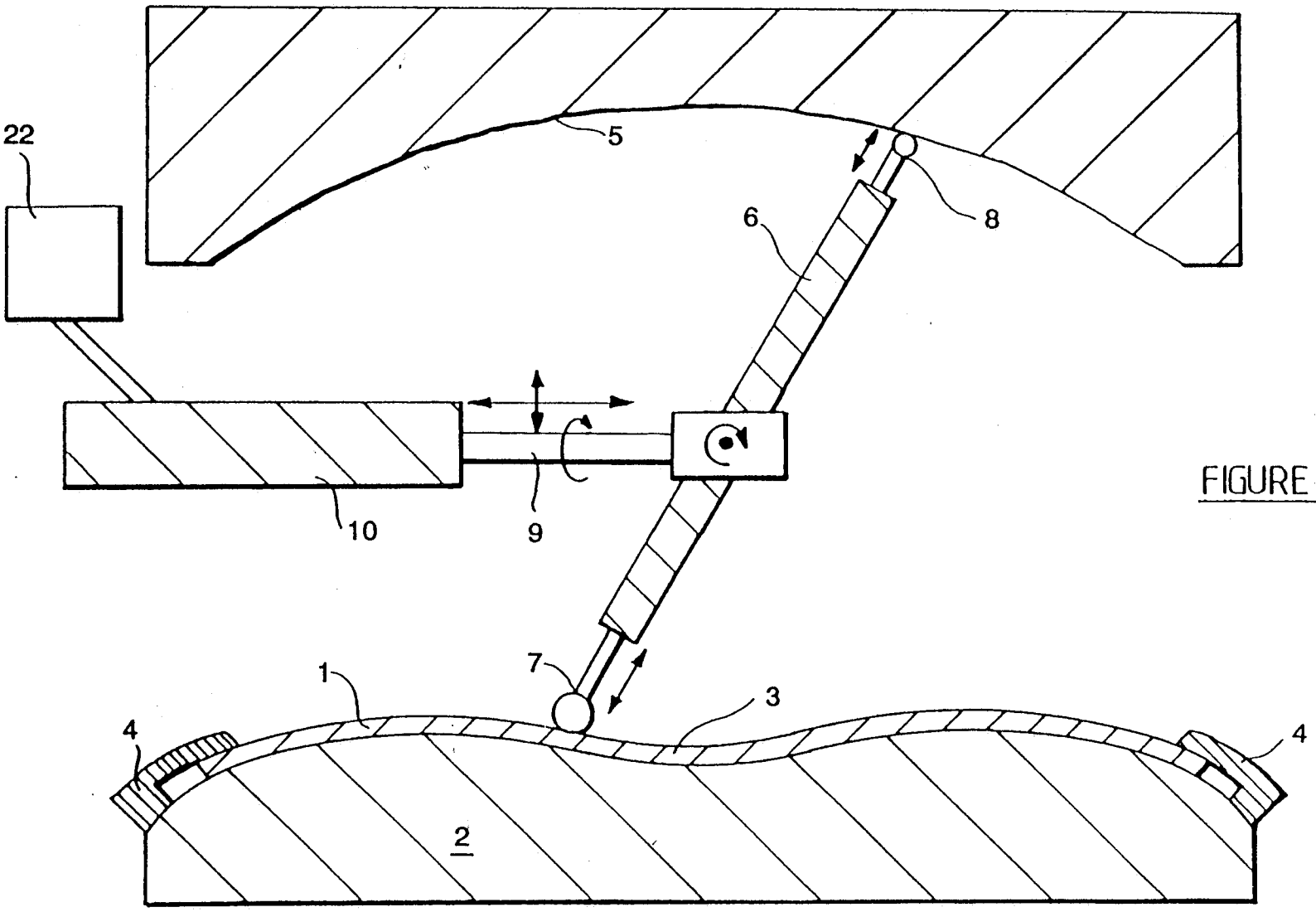

This invention relates to the forming of parts from ductile materials and is concerned particularly, although not exclusively, with forming parts from sheet metal.

In our British Patent No. 2 147 533, we disclose a method of and an apparatus for stretch forming metal parts. The reader's attention is directed specifically to the above-mentioned patent, the contents of which are incorporated herein by reference.

In our above-mentioned patent, we mention that the workpiece may be rolled or ironed whilst it is being stretched, and that such rolling or ironing may be carried out by a robotic device. It will be appreciated that, in order to achieve effective rolling or ironing of sheet metal, a substantial force has to be applied to the rolling or ironing tool, by the robotic device. Conventionally, the considerable rolling or ironing force will have to be reacted through the arm of the robotic device which positions the rolling or ironing tool. Generally, the higher the rolling or ironing force to be applied, the more substantially, complicated and expensive the robotic device must be.

Preferred embodiments of the present invention aim to provide improved means for applying such rolling or ironing pressures during stretch forming of metals, although the invention may have more general application.

According to one aspect of the present invention, there is provided to a method of applying a force to the surface of a workpiece, comprising the steps of disposing a force-applying means between a fixed reaction surface and the workpiece; applying a desired force to the surface of the workpiece by said force-applying means, which force is reacted by said reaction surface; and operating positioning means to so alter the position of said force-applying means as to apply said force to different parts of the surface of the workpiece.

According to a second aspect of the present invention, there is provided apparatus for applying a force to a surface of a workpiece, the apparatus comprising a fixed reaction surface, force-applying means for applying a force to the surface of the workpiece, which force is reacted by said reaction surface; and positioning means for so altering the position of said force-applying means as to apply said force to different parts of the surface of the workpiece.

In a preferred arrangement, the force applying means comprises a hydraulic device, and/or the positioning means comprises a robotic device.

A plurality of said force-applying means may be provided each to apply a respective force to the surface by said positioning means or a respective positioning means as aforesaid.

In a preferred arrangement, the or at least one of the force applying means is provided with a rolling or ironing tool by means of which the respective force is applied to the surface of the workpiece.

Alternatively or additionally, the or at least one of the force applying means may be provided with a cutting tool by means of which the respective force is applied to the surface of the workpiece.

A method as above may include the step of stretch forming the workpiece, during application of the or each said force to the surface of the workpiece.

Apparatus as above may include means for starch forming the workpiece during application of the or each said force to the surface of the workpiece.

According to a third aspect of the present invention, there is provided a method of stretch forming a workpiece, including the step of so treating an area of the workpiece before and/or during stretch forming as to inhibit buckling of the workpiece in said area during stretch forming.

Said treating step may comprises rolling or ironing said area during stretch forming of the workpiece. It may comprise applying a die to the surface of the workpiece. It may comprise perforating the workpiece.

A method according to the first aspect of the invention may also be in accordance with the third aspect of the invention.

Apparatus according to the second aspect of the invention may be arranged to carry out a method in accordance with the third aspect of the invention.

Figure 2:
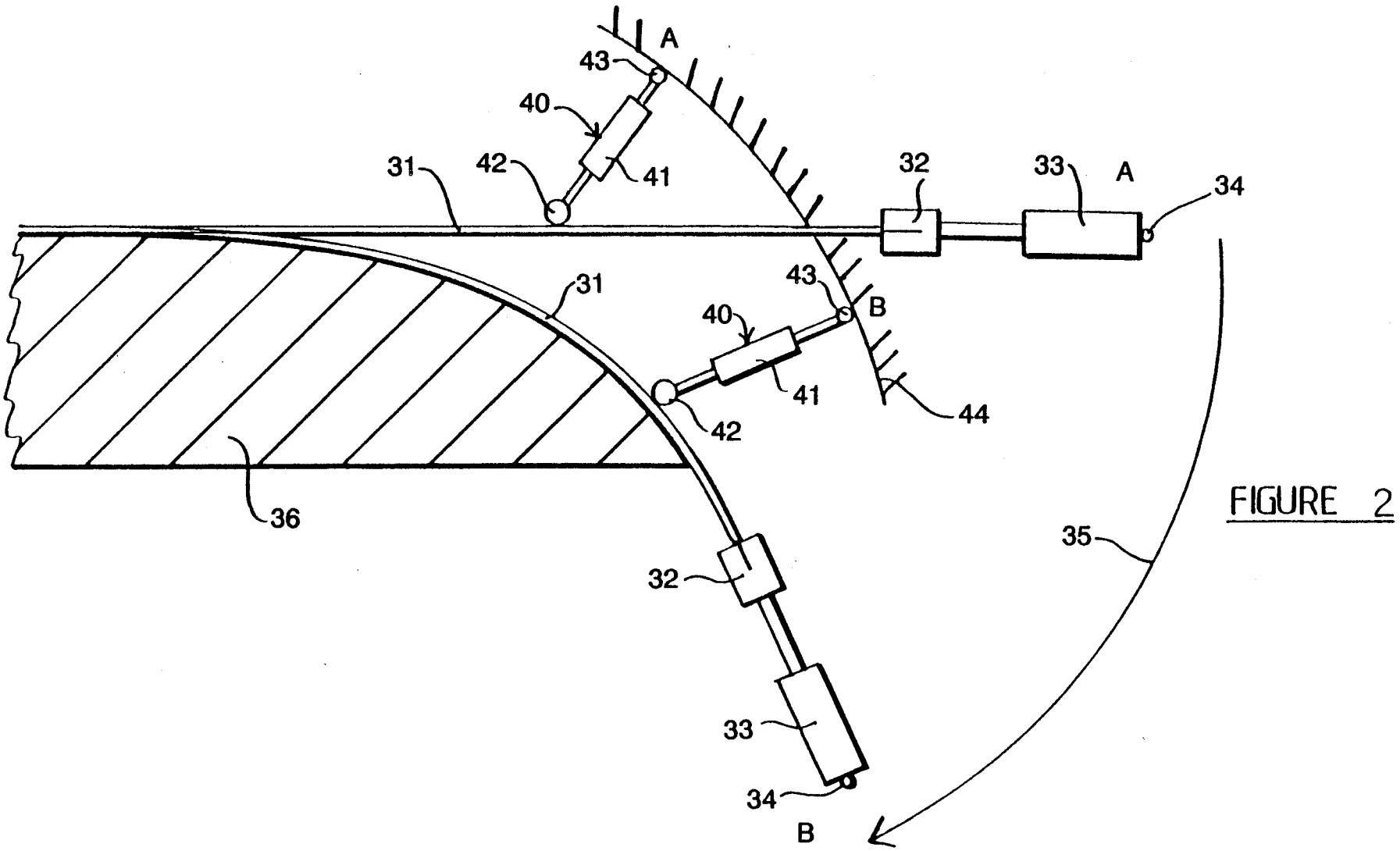

For a better understanding of the invention and to show how the same may be carried into effect, reference will now be made, by way of example, to the accompanying diagrammatic drawings, in which:

FIG. 1 illustrates both of a method of and apparatus for applying a rolling force to a workpiece, during stretch forming; and FIG. 2 illustrates both a method of and apparatus for inhibiting corner buckling during stretch forming.

In FIG. 1, the workpiece 1 comprises a sheet of metal which is stretched over a former 2 having a depression 3. The periphery of the workpiece 1 is gripped by appropriate grippers 4, which exert a pulling force to stretch the workpiece 1 over the former 2, in a manner as disclosed in our British Patent 2 147 533.

A fixed reaction surface 5 is disposed above the workpiece 1. In the illustration, the reaction surface 5 is partly spherical although, as mentioned below, it could have any desired shape.

A hydraulic ram 6 is disposed between the workpiece 1 and the reaction surface 5, and carries a rolling tool 7 at one end and roller 8 at the other. The ram 6 is gripped by the arm 9 of a robotic device 10, which is under the control of a central processing unit 22. The robotic device 10 may position the hydraulic ram 6 in any position and/or orientation.

In use, hydraulic fluid is supplied to the ram 6 so as to apply a force to the workpiece 1 via the rolling tool 7, which force is reacted via the roller 8 at the fixed reaction surface 5. The hydraulic fluid is supplied under servo control, so as to maintain a desired force of pressure at the surface of the workpiece 1. The robotic device 10 disposes the hydraulic ram 6 in a desired position and orientation such that the rolling force applied by the tool 7 is applied exactly where required.

It will be appreciated that, with this arrangement, considerable forces may be applied to the surface of the workpiece 1, through the relatively simple and robust hydraulic ram 6, which reacts its force at the fixed reaction surface 5. Thus, the rolling forces, which may be very considerable, do not have to be reacted through the robotic device 10, the purpose of which is simply to position the hydraulic ram 6. Thus, there is achieved an arrangement in which very substantial rolling force may be applied in virtually any desired direction, with respectively simple components. The hydraulic ram 6 provides the principal rolling force whilst the robotic device 10 has to provide only a relatively small force, to move the ram 6 as desired, between the workpiece 1 and the reaction surface 5.

The central processing unit 22 may control the overall operation of all parts of the apparatus—including the stretching forces applied via the grippers 4, the force applied by the hydraulic ram 6, and the position of the ram 6 as determined by the robotic device 10. As mentioned above, the reaction surface 5 may be of any design or shape. A part spherical configuration may be useful in facilitating the application of a force in many different desired directions. Alternatively, if desired, the reaction surface 5 may be flat, or it may have a configuration corresponding to that of the former 2.

It will be appreciated that, in use of the apparatus of FIG. 1, the rolling tool 7 may act on the workpiece 1 to form a depression therein, corresponding to the depression 3 provided on the former 2. Any desired number of additional rolling apparatuses may be employed to work simultaneously on the workpiece 1, to provide rolling forces in virtually any direction.

The robotic device 10 may include means (not shown, but known per se) of changing the rolling tool 7 automatically. Means may be provided for driving the rolling tool 7 positively in rotation, which may enhance performance of the apparatus. For example, such a powered drive of the rolling tool 7 may require less effort to alter the position of the ram 6 whilst the rolling tool 7 is working, and may provided enhanced rolling effect. If desired, the reaction roller 8 may be powered as well.

In the arrangement of FIG. 1, both ends of the hydraulic ram 6 are freely moveable, under the control of the robotic device 10. However, in a simpler arrangement, the end of the ram 6 at the reaction surface 5 may be fixed—for example, by means of a pivot joint or ball joint, which replaces the roller 8. Such a simplified configuration may be useful in forming repetitively parts of relatively simple shape.

Reverting to the arrangement as illustrated in FIG. 1, the reaction surface 5 may be formed with tracks within which movement of the reaction roller 8 is constrained. This may be particularly useful for the repetitive forming of simple shapes.

Although the arrangement of FIG. 1 is described for use with a stretch forming process as disclosed in our British Patent 2 147 533, the method of and apparatus for applying force to a workpiece may have generally wider application. Although the illustrated arrangement is described for use in applying a rolling pressure, it is to be appreciated that the force may be applied for other purposes—e.g. ironing, or even for other purposes such as cutting.

In FIG. 2, a workpiece 31 is stretch formed over a former 36, by a process generally as disclosed in our British Patent 2 147 533. To this end, the workpiece 31 is gripped at a plurality of points by respective grippers 32, only one of which is illustrated in FIG. 2. The gripper 32 is pulled by a puller 33, one end 34 of which is constrained to follow a generally arcuate path 35. In FIG. 2, the gripper 32/puller 33 are shown as stretching the workpiece 31 (of sheet metal) at a corner. The upper illustrated position A of the gripper 32 is with the workpiece 31 in its initial, generally unworked position. The lower illustrated position B of the gripper 32/puller 33 is that occupied when the workpiece 31 has been pulled to the desired configuration, over the former 36.

When a sheet metal workpiece is formed at a corner, there is a tendency for buckling to take place. When such a workpiece is formed in a pressing tool, such tendency toward buckling may not be readily apparent, due to the confinement of the metal between the die walls and the high pressure used to form the metal. However, internally, the workpiece may well exhibit symptoms of latent buckling, such as various gradations in thickness and internal structure.

It will be appreciated that, when utilizing a stretch forming process as disclosed generally in our British Patent 2 147 533, there may be no similar means to restrain buckling. Therefore, as illustrated in FIG. 2, one or more rolling device 40 are provided, in the vicinity of the corner being formed. One such rolling device 40 is shown in FIG. 2, and is arranged similarly to the device shown in FIG. 1. Thus, the rolling device 40 comprises a hydraulic ram 41, having a rolling tool 42 at one end and a roller 43 at the other end. The rolling tool 42 exerts a force against the workpiece 31, which force is reacted against reaction surface 44.

Movement of the rolling device 40 is controlled by a robotic device under computer control, in much the same way as is illustrated in FIG. 1.

The rolling device 40 is shown in FIG. 2 as occupying two different positions—an initial position A with the workpiece 31 in its initial state, and a final position B, with the workpiece 31 in its final state.

Thus, as the workpiece 31 is stretched formed under the pulling effort exerted by the various gripper 32/puller 33 arrangement, the or each rolling device 40 works on the workpiece 31, to roll out any nascent buckles, and maintain the metal of the workpiece 31 in contact with the former 36.

It will be appreciated that, as the metal of the workpiece 31 is stretched formed in a more or less accessible environment, its behaviour can be monitored during stretching, and all of the various pulling and rolling device controlled accordingly. Therefore, a nascent buckle can be monitored and treated under servocontrol. Moveover, behaviour of a workpiece such as 31 under buckling conditions can be monitored experimentally, steps taken to prevent the buckling, and such preventative steps repeated under computer control for repetitive formings to the same shape.

As an alternative to the rolling device 40 illustrated in FIG. 2, there may be provided at least one similar device which is adapted to iron a respective area of the workpiece 31, to inhibit buckling.

Although the illustrated rolling device 40 is shown and described to be a form a similar to that of FIG. 1, it may be of alternative configuration. For example, it could comprise a more or less conventional robotic device in which force is applied through a rolling tool or other tool, without an additional reaction surface such as 44. There may be provided at least one rolling or other device such as 40 which is mounted (for example, by means of a yoke) upon a respectively puller 33. The rolling or other tools of such devices may have separate positioning and/or force applying rams.

The or each rolling tool 42 (or alternative) may run either up or down a nascent buckle area, as the workpiece 31 is being formed.

As an alternative to utilizing mobile tools such as rolling or ironing tools, a stationary tool may simply be placed upon the workpiece 31 and urged against it, during forming. Such a stationary tool may be a replica of the former 36—as a die—so that, in the local area of the corner (or other area where buckling may take place), the workpiece 31 is confined as in a press.

An alternative or additional means of inhibiting buckling is to perforate the workpiece 31 between the gripper(s) 32 and the former 36—that is, a hole (or partial hole) may be made, forward of at least one of the gripper 32. As the workpiece 31 is pulled during forming, such a hole may elongate, and help to accommodate material which may be displaced in a nascent buckling situation. In this respect, it will be appreciated that, in many cases, there will be an area of waste material which remains between the former 36 and the gripper 32, and such perforation of the workpiece 31 may be formed conveniently in such an area of waste material.

I claim:

1. A method of repetitively stretch forming a plurality of workpieces, said method comprising the steps of:

placing a first workpiece on a former;

gripping the first workpiece by at least one gripper;

pulling the first workpiece to a desired configuration over the former by said at least one gripper so as to stretch form the first workpiece to a shape defined by the former;

disposing a force-applying means between a fixed reaction surface and the first workpiece;

monitoring the behavior of the first workpiece as it is stretch formed to detect any regions where the first workpiece tends to leave the former;

applying a force to a surface of the first workpiece by said force-applying means, which force is reacted by said force-applying means and said reaction surface;

operating a positioning means to so alter the position of said force-applying means as to apply said force to different parts of the surface of the first workpiece in response to said monitoring of the behavior of the first workpiece, in order to maintain said regions of the first workpiece in contact with the former, such that said force continues to be reacted through said force-applying means and said reaction surface in preference to being reacted through said positioning means, said positioning means being operable to alter the position of said force-applying means independently of the position of said at least one gripper; and subsequently carrying stretch forming of at least one further said workpiece during which the operations of the force-applying and positioning means during stretch forming of the first workpiece are repeated and are computer controlled to achieve repetitive stretch formings to the same shape.

2. A method according to claim 1, wherein the force applying means comprises a hydraulic device.

3. A method according to claim 1, wherein the positioning means comprises a robotic device.

4. A method according to claim 1, wherein a plurality of said force-applying means are provided each to apply a respective force to the surface by said positioning means or a respective positioning means as aforesaid.

5. A method according to claim 1, wherein the or at least one of the force applying means is provided with a rolling or ironing tool by means of which the respective force is applied to the surface of the workpiece.

6. A method according to claim 5, wherein the or at least one of the force applying means is provided with a cutting tool by means of which the respective force is applied to the surface of the workpiece.

7. A method according to claim 1, wherein said positioning means is arranged to move said force-applying means in more than one plane of movement.

8. A method according to claim 7, wherein said force-applying means has two ends, both of which are independently movable in response to said positioning means.

* * * * *